US006425545B1

(12) United States Patent
Adcock et al.

(10) Patent No.: US 6,425,545 B1
(45) Date of Patent: Jul. 30, 2002

(54) METHOD AND APPARATUS OF BUILDING MULTIPLE PACKAGES ON A SINGLE COLLET

(75) Inventors: Joseph Anthony Adcock, Heath; Clark Thomas Forbes, Newark, both of OH (US); Keith Brian Richey, Anderson, SC (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/676,393

(22) Filed: Sep. 29, 2000

(51) Int. Cl.[7] ..... B65H 54/22; B65H 54/28

(52) U.S. Cl. ..... 242/474.8; 242/477.1; 242/483.5; 242/920

(58) Field of Search ..... 242/477.1, 474.8, 242/474.6, 483.5, 480.2, 920

(56) References Cited

U.S. PATENT DOCUMENTS

| | | | | |
|---|---|---|---|---|
| 2,204,475 A | | 6/1940 | Crandall | |
| 2,207,615 A | | 7/1940 | Crandall | |
| 2,226,221 A | | 12/1940 | Crandall | |
| 2,235,737 A | * | 3/1941 | Crandall | 242/474.8 |
| 2,622,810 A | | 12/1952 | Stream et al. | |
| 2,863,612 A | | 12/1958 | Sherwin | |
| 2,932,461 A | | 4/1960 | Kimberly | |
| 3,041,664 A | * | 7/1962 | Green | 242/920 X |
| 3,151,963 A | * | 10/1964 | Cochran | 242/920 X |
| 3,334,980 A | | 8/1967 | Smith | |
| 3,394,895 A | * | 7/1968 | Hogg | 242/474.8 |
| 3,823,885 A | | 7/1974 | DeSchulthess | |
| 4,111,376 A | | 9/1978 | Hoddinott et al. | |
| 4,300,728 A | | 11/1981 | Andre et al. | |
| 4,396,162 A | | 8/1983 | Braziel | |
| 4,431,138 A | * | 2/1984 | Schiminski et al. | 242/474.6 |
| 4,545,542 A | | 10/1985 | Frazee, Jr. et al. | |
| 4,553,706 A | | 11/1985 | Frazee, Jr. et al. | |
| 4,784,341 A | | 11/1988 | Hill et al. | |
| 4,848,687 A | | 7/1989 | Myers et al. | |
| 5,522,560 A | | 6/1996 | Fleissner | |
| 5,603,460 A | | 2/1997 | Reid | |
| 5,853,133 A | * | 12/1998 | Smith | 242/483.5 X |
| 6,040,003 A | * | 3/2000 | Smith | 242/483.5 X |

FOREIGN PATENT DOCUMENTS

| | | |
|---|---|---|
| JP | 61 211279 A | 9/1986 |

* cited by examiner

*Primary Examiner*—Michael R. Mansen
(74) *Attorney, Agent, or Firm*—Inger H. Eckert; Stephen W. Barns

(57) ABSTRACT

An apparatus for forming multiple packages on a single collet includes a pair of collets that are mounted on a rotatable turret. A moving strand is provided and the collet is rotated to wind the strand and build a first package on one end of the collet. The strand is reciprocated with a strand reciprocator to lay the strand on the package surface as the package rotates. After the first package is built, a strand positioner and a secondary shoe assist in transferring the strand to build a second package on the collet. After the second package is built, the turret is rotated while the cam moves away from the collet and turret. The strand breaks off after a few revolutions of the second collet. Then, the cam moves toward the second collet to begin building a first package on the second collet.

19 Claims, 6 Drawing Sheets

METHOD AND APPARATUS OF BUILDING MULTIPLE PACKAGES ON A SINGLE COLLET

TECHNICAL FIELD

This invention relates to the production of glass fibers, and in particular, to winding a glass fiber strand to form packages. More particularly, this invention relates to a method and apparatus of building multiple packages on a single collet.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a strand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand. The size also improves the bond between the strands and the plastic matrix. The size may also include bonding agents which allow the fibers to stick together, thereby forming an integral strand. It is to be understood that the use of a size is optional.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in a manner which enables the strand to be easily unwound, or paid out. It has been found that a winding pattern consisting of a series of helical courses laid on the collet builds a package which can easily be paid out. Such a helical pattern prevents adjacent loops or wraps of strand from fusing together should the strand be still wet from the application of the size material. The helical courses are wound around the collet as the package begins to build. Successive courses are laid on the outer surface of the package, continually increasing the package diameter, until the winding is completed and the package is removed from the collet.

A strand reciprocator guides the strand longitudinally back and forth across the outer surface of the package to lay each successive course. A known strand reciprocator is the spiral wire type strand oscillator. It consists of a rotating shaft containing two outboard wires approximating a spiral configuration. The spiral wires strike the advancing strand and direct it back and forth along the outer surface of the package. The shaft is also moved longitudinally so that the rotating spiral wires are traversed across the package surface to lay the strand on the package surface. While building the package, the spiral wire strand oscillator does not contact the package surface. Although the spiral wire strand oscillator produces a package that can be easily paid out, the package does not have square edges.

A known strand reciprocator which produces square edged, cylindrical packages includes a cam having a helical groove, a cam follower which is disposed within the groove and a strand guide attached to the cam follower. As the cam is rotated, the cam follower and strand guide move the strand longitudinally back and forth across the outer surface of the rotating package to lay each successive course. A rotatable cylindrical member, or roller bail, contacts the outer surface of the package as it is being built to hold the strand laid in the latest course in place at the package edges as the strand guide changes direction. The roller bail is mounted for rotation, and bearings are used to reduce the friction between the roller bail and the mounting surface. The collet and package are rotating at high speeds during winding. The contact between the roller bail and the rotating package surface causes the roller bail to rotate, and the speed of the roller bail surface is generally equal to the high rotational speed of the package surface. The roller bail has a fixed diameter which is generally less than the diameter of the collet, and may be only 10% of the collet diameter. Therefore, the roller bail must rotate at higher revolutions per minute (RPMs) to keep the roller bail surface traveling at the same speed as the speed of the package surface. To operate effectively throughout the preferred range of package sizes and preferred collet speeds during winding the roller bail may have to rotate at 70,000 RPMs or higher.

The rotating rollers of the roller bails contact the strand as it is laid on the package surface. If the speed of the roller bail surface does not match the speed of the package surface, the roller bail will apply abrasive forces against the strand, and this can break some of the fibers in the strand. Bearings are provided between the roller bail mounts and the rotating roller bail to reduce friction and allow the roller bail to rotate at high RPMs. Typical grease lubricated bearings which have been used in the past have been found not to reduce the friction enough to allow the roller bails to operate at such high RPMs without causing abrasive forces against the strand which can break strand fibers. The strand reciprocator has other moving parts in addition to the roller bails with surfaces which need lubrication. The rotating cam has bearings which use lubrication. The cam follower needs lubrication while it moves along the groove on the cam surface.

Several attempts have been made to form multiple packages on a single collet. For example, U.S. Pat. No. 2,204,475 to Crandall discloses making multiple packages on cores 19 that are temporarily attached to sleeve 3. The sleeve is slid onto the spindle, and the sleeve is indexed one groove at a time to wind the packages one groove at a time. Then, the entire sleeve is removed. However, Crandall does not disclose a cam or builder, and the sleeve on which packages are built is moved or indexed for each package.

U.S. Pat. No. 3,334,980 to Smith discloses two forming packages on one spindle. However, the packages that are formed have tapered ends and not substantially square edges.

U.S. Pat. No. 2,207,615 to Crandall discloses multiple packages on a single sleeve. The packages are square edged. Successive cores are successively moved past the package building position. During changeover from one package to the next the guide is removed from contact with the package. Crandall's several embodiments all call for multiple guides (i.e., cams or builders) to accommodate several packages, or indexing of the cores to build successive packages at the same operating or building position.

U.S. Pat. No. 4,784,341 to Hill et al. discloses a thread winding apparatus where two successive spools of thread are wound. A guide 2 has opposed fingers 18, 20 for guiding the thread. A cam 6 on threaded rod 4 reciprocates the guide left and right. The motor driving the threaded rod reverses itself as the guide reaches each end of the spool. Upon completion of the first package shown in FIG. 1 the cam is lifted out of contact with the threaded rod and the cam and guide are moved axially to the right or outward direction to be in position to wind the next spool of thread. However, Hill's packages are not square-edged, but rather are maintained in their form by virtue of the sides or rims of the spool. Further, the fingers 18, 20 of the guide merely guide the thread in a reciprocal fashion. In addition, the reciprocation in Hill is accomplished by the reversal of the rotational direction of the threaded rod 4.

It has been found that the interruption of attenuation of the strands at the completion of each package results in instabilities at the stream feeder or bushing with the formation of each package. Each interruption of attenuation to doff the package and apply an empty tube or collector to the mandrel involves reducing high speed linear attenuation of the strands. During this reduction of speed the strands become non-uniform in diameter, resulting in fiber that must be scrapped. Also, after doffing, while the collet and collector are brought up to proper attenuating speed, the attenuated strands are of non-uniform diameter, and these fibers must also be scrapped. Thus, it would be desirable to provide a method and apparatus for successively winding multiple separate packages of strand mounted in end-to-end relationship on a single collet. Preferably the transfer of the strand from one package position to another can be accomplished without the interruption of attenuation that normally occurs when the winding of one package is completed and the transfer of the strand is effected to build another package.

SUMMARY OF THE INVENTION

The above objects as well as other objects not specifically enumerated are achieved by a method of building multiple wound packages of strand on a collet, the method comprising the steps of providing a collet, supplying a continuous strand to the collet, and rotating the collet to wind the strand to build a first package at a first location on the collet. The strand is reciprocated from one end of the package to the other end of the package using a strand reciprocator that includes a rotating cam and a cam follower having a stand guide. The strand is reciprocated from the one end to the other end as the package rotates, thereby forming strand courses. The strand courses are held in place at edge portions of the package as the strand guide changes direction to make a square edged package. At the completion of the first package the strand is transferred to a second location on the collet so that a second package can be built at the second location. The strand transfer includes moving the strand reciprocator away from the collet, directing the strand from the first location to the second location, and moving the strand reciprocator into engagement with the collet to build a second package at the second location.

According to this invention, there is also provided a method of building multiple wound packages of strand on a collet, the method comprising the steps of providing a collet, supplying a continuous strand to the collet, and rotating the collet to wind the strand to build a first package at a first location on the collet. The strand is reciprocated from one end of the package to the other end of the package using a strand reciprocator that includes a rotating cam and a cam follower having a strand guide. The strand reciprocator reciprocates the strand from the one end to the other end as the package rotates, thereby forming strand courses. The strand courses are held in place at edge portions of the package as the strand guide changes direction to make a square edged package. At the completion of the first package the strand is transferred to a second location on the collet so that a second package can be built at the second location. The strand transfer includes moving the strand reciprocator away from the collet and directing the strand from the first location to the second location by engaging the strand with a strand positioner. The strand positioner is moved laterally along the direction of the length of the collet to move the strand to the second location. The strand is disengaged from the strand positioner. The secondary shoe and strand positioner are controlled with a controller during the movement of the strand from one package location to another package location. The strand reciprocator is then moved into engagement with the collet to build a second package at the second location.

According to this invention, there is also provided apparatus for building multiple packages on a collet, comprising a rotatable collet, a primary shoe located upstream of the collet for forming a fibrous strand, and a secondary shoe for directing the strand to the collet. A strand positioner is mounted for movement toward the strand for engagement with the strand and away from the strand for disengagement with the strand. The strand positioner is adapted to position the strand at multiple package locations on the collet to enable building a package at each of the package locations. A strand reciprocator includes a rotating cam and a cam follower having a strand guide. Rotation of the cam reciprocates the strand from one end of the package to the other end of the package as the collet rotates, thereby enabling the strand to be wound on the collet in courses. A roller bail holds the strand courses in place at edge portions of the package as the strand guide changes direction to make a square edged package. The secondary shoe and strand positioner can be operated to move the strand from one package location to another package location on the collet.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
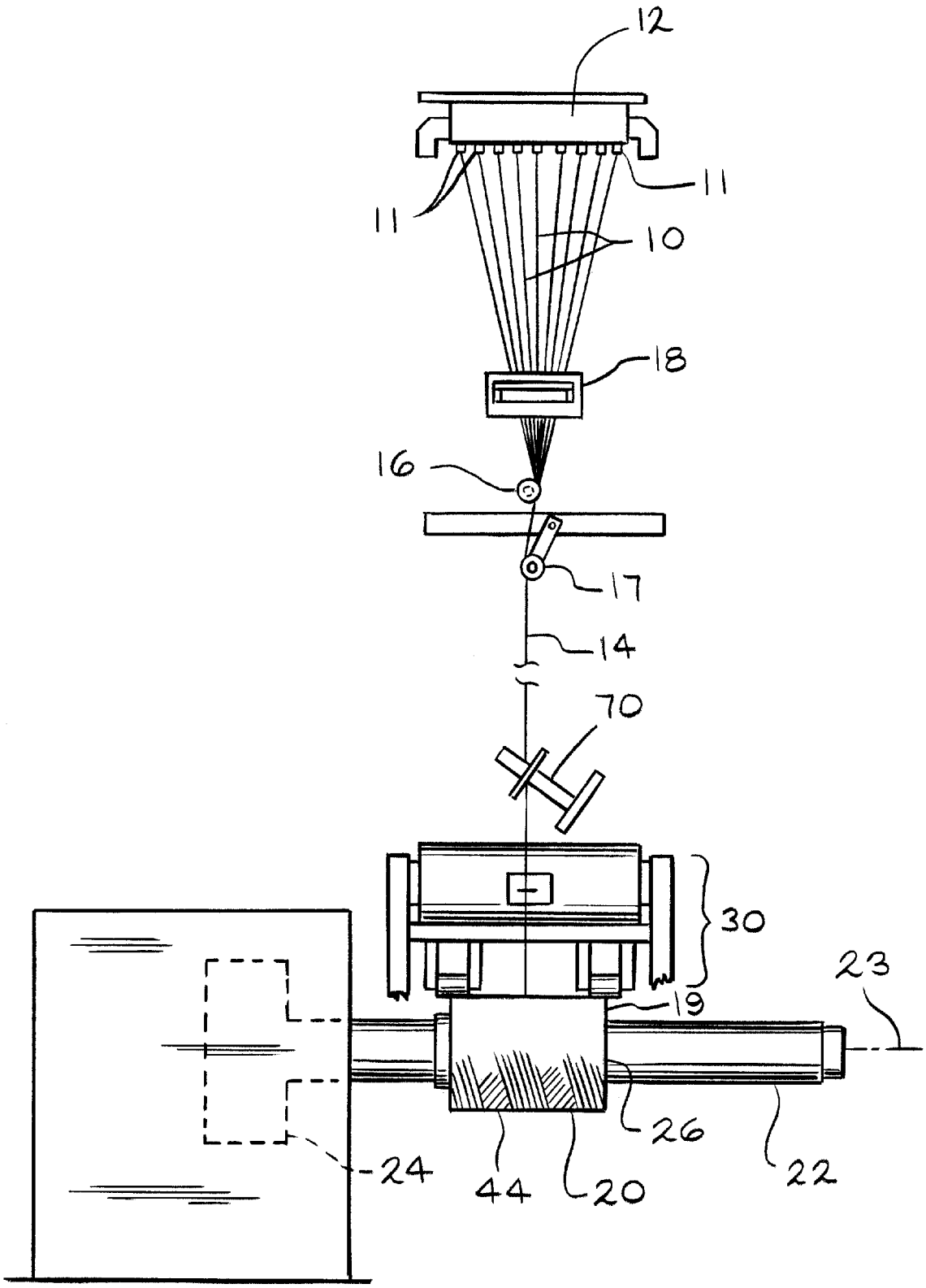
FIG. 1 is a schematic view in elevation of apparatus for forming, collecting and winding fiber strands according to the principles of the invention.
Figure 2:
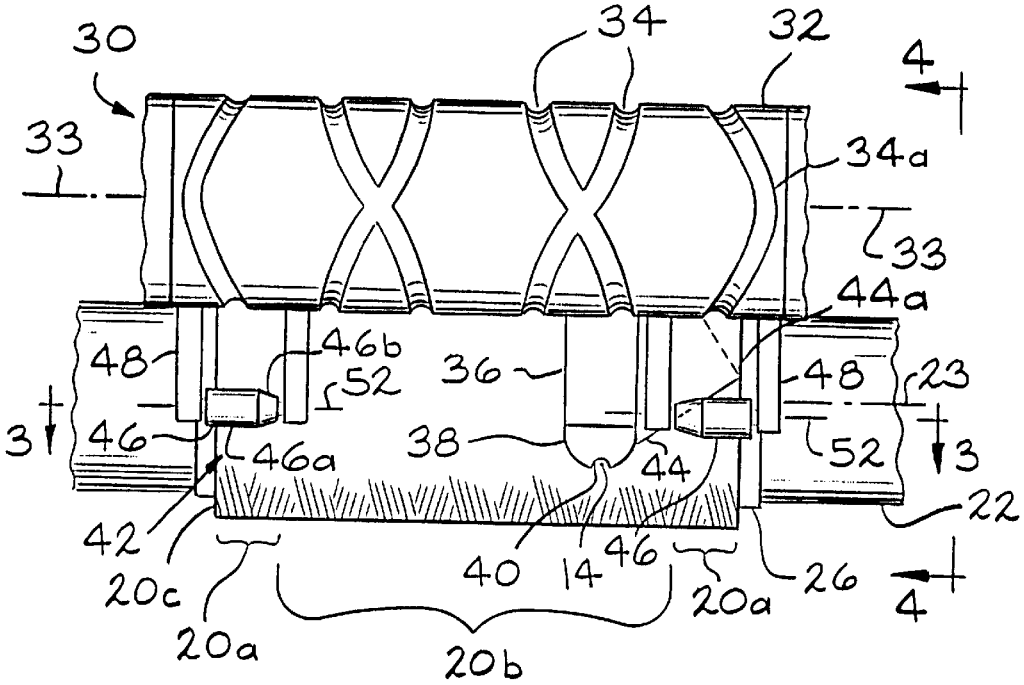
FIG. 2 is an enlarged, plan view in elevation of the strand reciprocator shown in FIG. 1.

FIGS. 1 and 2 show an apparatus for forming, collecting, and winding strands in which fibers 10 are drawn from a plurality of orifices 11 in a bushing 12 and gathered into a strand 14 by means of a gathering member or primary shoe device 16. A size suitable for coating the fibers can be applied to the fibers by any suitable means, such as size applicator 18. The strand is then passed around a secondary shoe device 17 for properly positioning or directing the strand 14 onto a rotating collet 22 to build a cylindrical package 19. The package, formed from a continuous, long strand, has a radially outer surface 20 with edge portions 20*a* and a central portion 20*b* between them. The edge portions 20*a* form generally right angles with the package ends 20*c*. The outer surface of the cylindrical package is preferably between about 10 cm to about 40 cm long, but may be longer or shorter depending on the application. The collet is adapted to be rotated about an axis of rotation 23 by any suitable means such as a motor 24. Any suitable package core material such as a cardboard tube 26 can be disposed on the collet to receive the strand package. It is to be understood that a plurality of strands could be used instead of a single strand.

Figure 6:
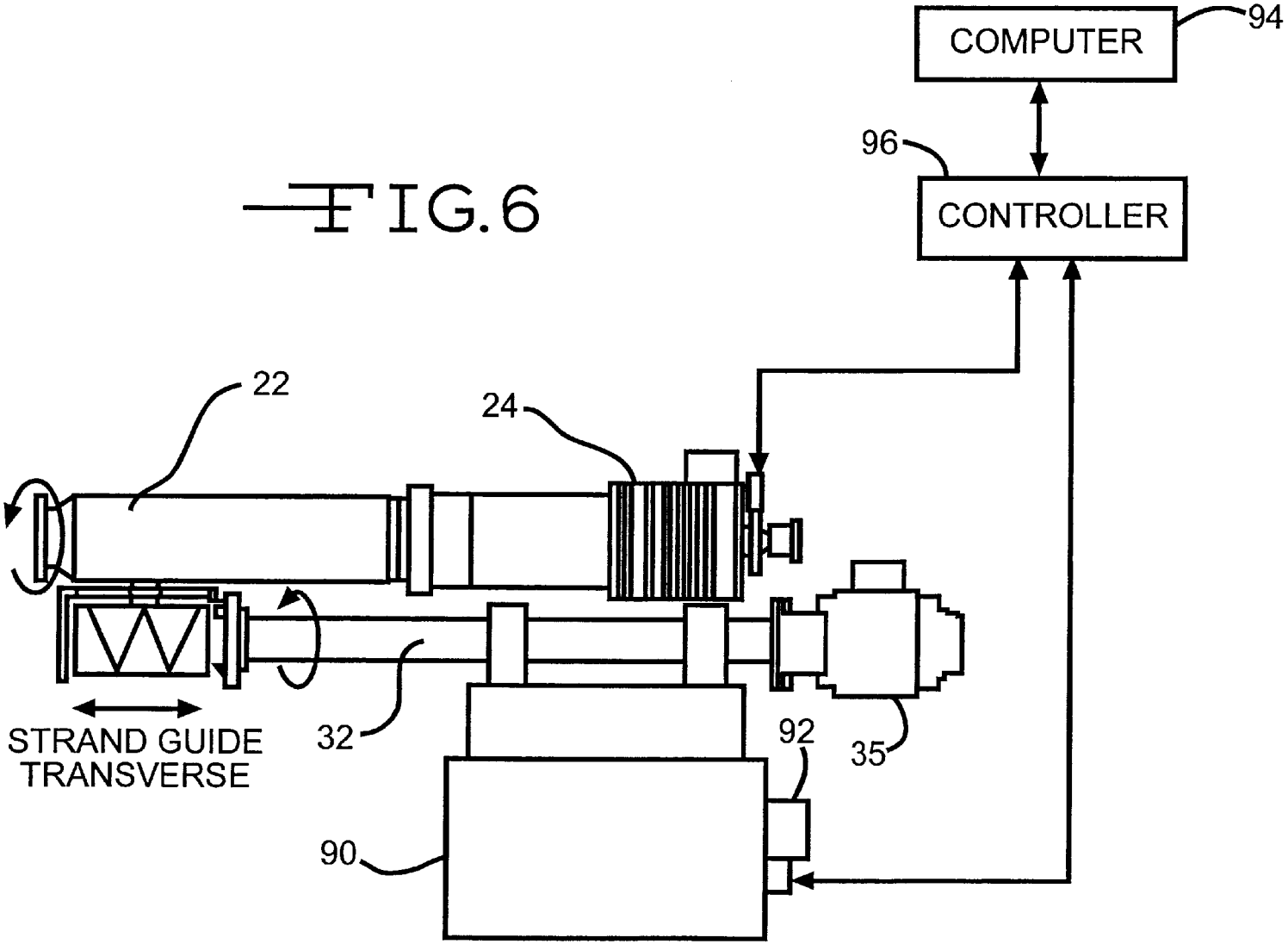
FIG. 6 is a block diagram of the control system for the invention.

Referring now to FIG. 2, a strand reciprocator 30 guides the strand 14 laterally back and forth across the package surface 20 to lay the strand in courses 44 on the package surface. The strand reciprocator includes a cylindrical cam 32 having a helical groove 34. The cam 32 is adapted for rotation about an axis 33 by any suitable means such as a motor 35 (FIG. 6). The cam is preferably made of a hard material, such as stainless steel, but any suitable material can be used. The strand reciprocator further includes a cam follower 36 disposed in the groove 34. The cam follower extends outwardly from the cam and a strand guide 38 is attached to the end. The cam follower is preferably made of a plastic or nylon material, but any suitable material can be used. A notch 40 is formed in the strand guide to hold the strand 14. Rotation of the cam causes the cam follower to follow the helical groove, thereby causing the strand guide to move laterally across the package surface.

Figure 3:
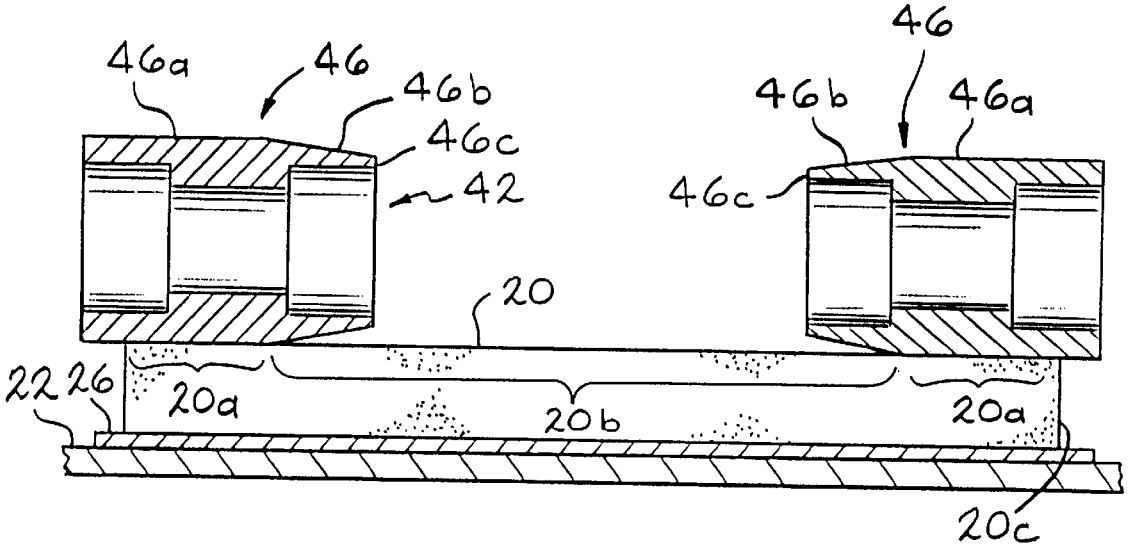
FIG. 3 is a schematic sectional view in elevation of the apparatus of FIG. 2, taken along line 3—3.

Referring now to FIGS. 2 and 3, the strand reciprocator further includes a roller bail assembly 42 for holding the strand courses 44 in place at the edge portions 20*a* of the package surface 20 as the strand guide 38 changes direction. The roller bail assembly includes a pair of spaced apart, or split rollers 46. The rollers have generally cylindrical edge ends 46*a* and tapered inner ends 46*b*. The cylindrical edge ends contact the package surface at the edges 20*a*. The tapered inner ends extend from the edge ends towards the central portion of the package surface 20*b*. The rollers do not contact the surface of the package at the central portion of the package 20*b*. Each of the rollers 46 is independently mounted by mounts 48. One or more bearings (not shown) are located between the roller bails and the mounts to allow the roller bails to rotate freely by reducing friction. The bearings are preferably open, ball bearing type bearings. Although the roller bails are shown as mounted at both the edge ends and the inner ends, the roller bails may be cantilevered, being mounted at only one end. Each roller is made from a hard material, such as stainless steel, but any suitable material may be used. The rollers preferably weigh approximately 50 grams each, but may be heavier or lighter depending on their size and the application. They are preferably hollow to minimize weight and inertia, but may be solid. Each roller is preferably about 2 cm long, but they may be longer or shorter depending on the application. Although split roller bails are preferred, a single roller bail can be used.

The split roller bails are preferably coaxial, contacting the package surface along a portion of a line 52 which is generally parallel to the package axis of rotation 23, although any suitable orientation of the roller bails may be used. Using 2 cm long roller bails, the length of contact between the roller bails and the typical package surface will be approximately 10% to 50% of the length of the outer surface of the package. A longer or shorter length of contact between the roller bails and the package surface may be used depending on the application.

Figure 4:
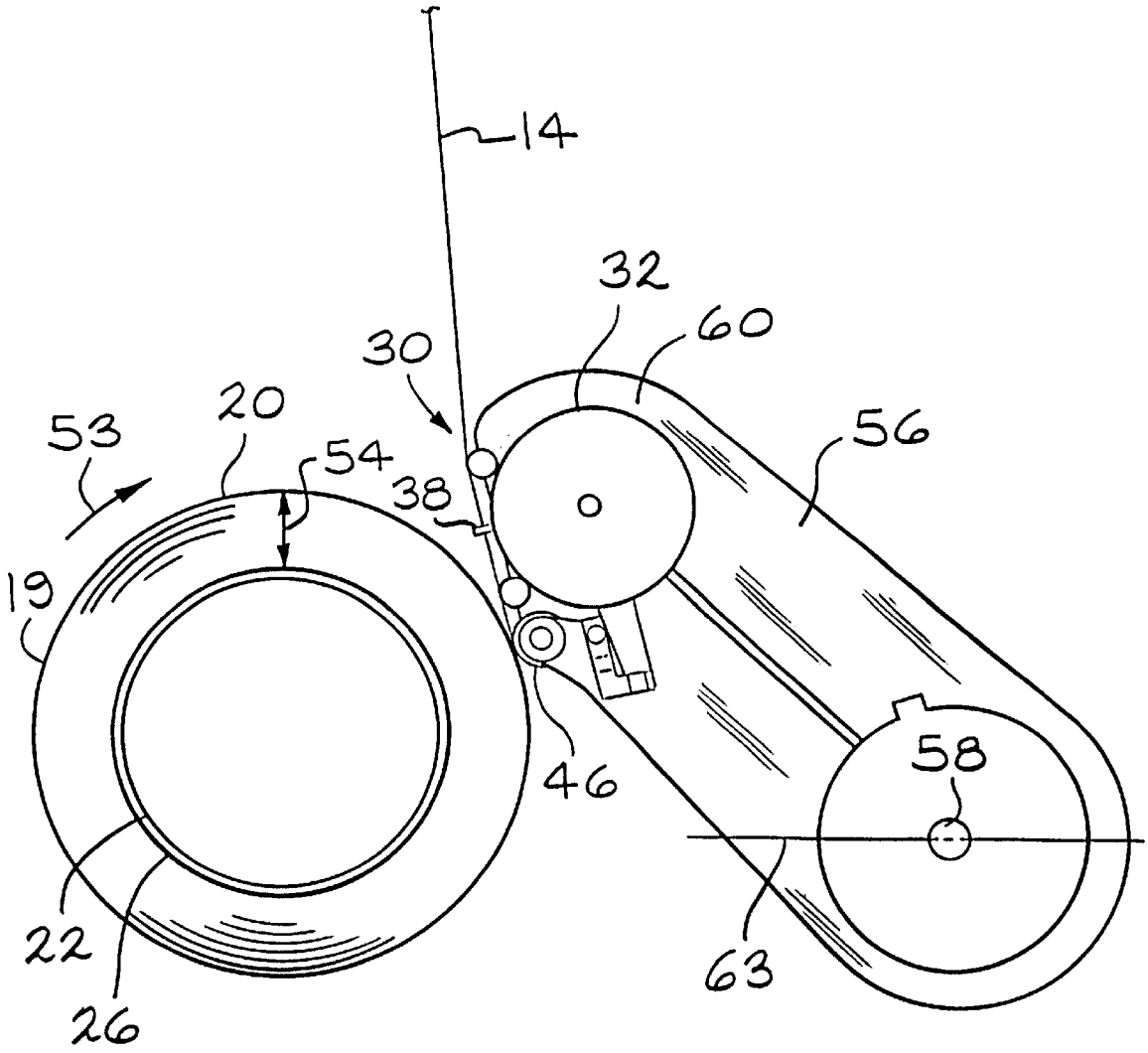
FIG. 4 is an end view in elevation of a portion the roller bail assembly of FIG. 1.

The package rotates during winding as shown by line 53 in FIG. 4. As the package builds, the radius 54 increases. To accommodate the increasing package radius, the strand reciprocator 30 is mounted on an arm 56. To accommodate the increasing package radius, the arm moves away from the collet along line 63 to keep the proper contact between the surface of the rollers and the package surface, and to prevent the strand courses 44*a* from pulling away from the edge portions 20*b* of the package surface. A strand positioner 70 may be provided to facilitate the positioning of the strand 14 on the collet 22. The strand positioner 70 is capable of lateral movement, i.e., along the direction of the length of the collet 22, as well as movement toward and away from the collet 22. Preferably the movement toward or away from the collet is pivotal movement, although other movement can be used. In this manner, the strand positioner 70 can be precisely positioned at any desired position with respect to the collet 22.

In operation, the strand reciprocator 30 guides the strand 14 as it is laid on the outer surface of the package. The strand is held by notch 40 in the guide eye or strand guide 38 and wound around the rotating collet 22 or a package core 26 disposed about the collet. The cam 32 is oriented near the package and rotates about the axis 33 generally parallel to the package axis of rotation 23. The cam follower is disposed within the cam groove 34, but is prevented from rotating with the cam. As the cam rotates, the cam follower is moved laterally by the helical groove in a direction generally parallel to the package axis of rotation 23. The helical groove is continuous, having curved ends 34*a* that cause the cam follower to move to the end of the package and then reverse direction. The strand guide 38 is attached to the cam follower and it traverses the outer surface of the package, reciprocating back and forth from end to end. The strand guide 38 contacts the surface of the package as it traverses the outer surface of the package.

The helical winding pattern of each strand course 44 is formed by reciprocating the strand across the package surface while rotating the package. As the strand guide 38 approaches the edge of the package 20*a*, the strand is laid on the package surface under the roller tapered inner edge 20*b*. The strand guide 38 continues to move towards the edge 20*c* of the package and the strand course, shown in phantom at 44*a* in FIG. 2, moves between the package surface and the cylindrical edge end of the roller which is in contact with the package surface. When the cam follower travels through the curved end 34*a* of the groove 34, the strand guide 38 changes direction and moves away from the package edge 20*c* and towards the central portion of the package 20*b*. The contact between the roller bails and the package surface holds the strand course 44*a* in place at the edge of the package surface 20 as the strand guide 38 changes direction. By preventing the strand courses 44*a* from pulling away from the package edges 20*c* as the strand guide moves back towards the center of the package 20*b*, a cylindrical package having square edges 20*c* is built. It will be appreciated that although it is not necessary for the roller bails to contact the package surface to build a cylindrical package having square edges, a preferred method of forming the cylindrical package is to have the strand guide 38 contacting the package surface. As the package increases in diameter, the strand guide 38 must be backed off radially away from the package to maintain the desired amount of force against the package.

Figure 5:
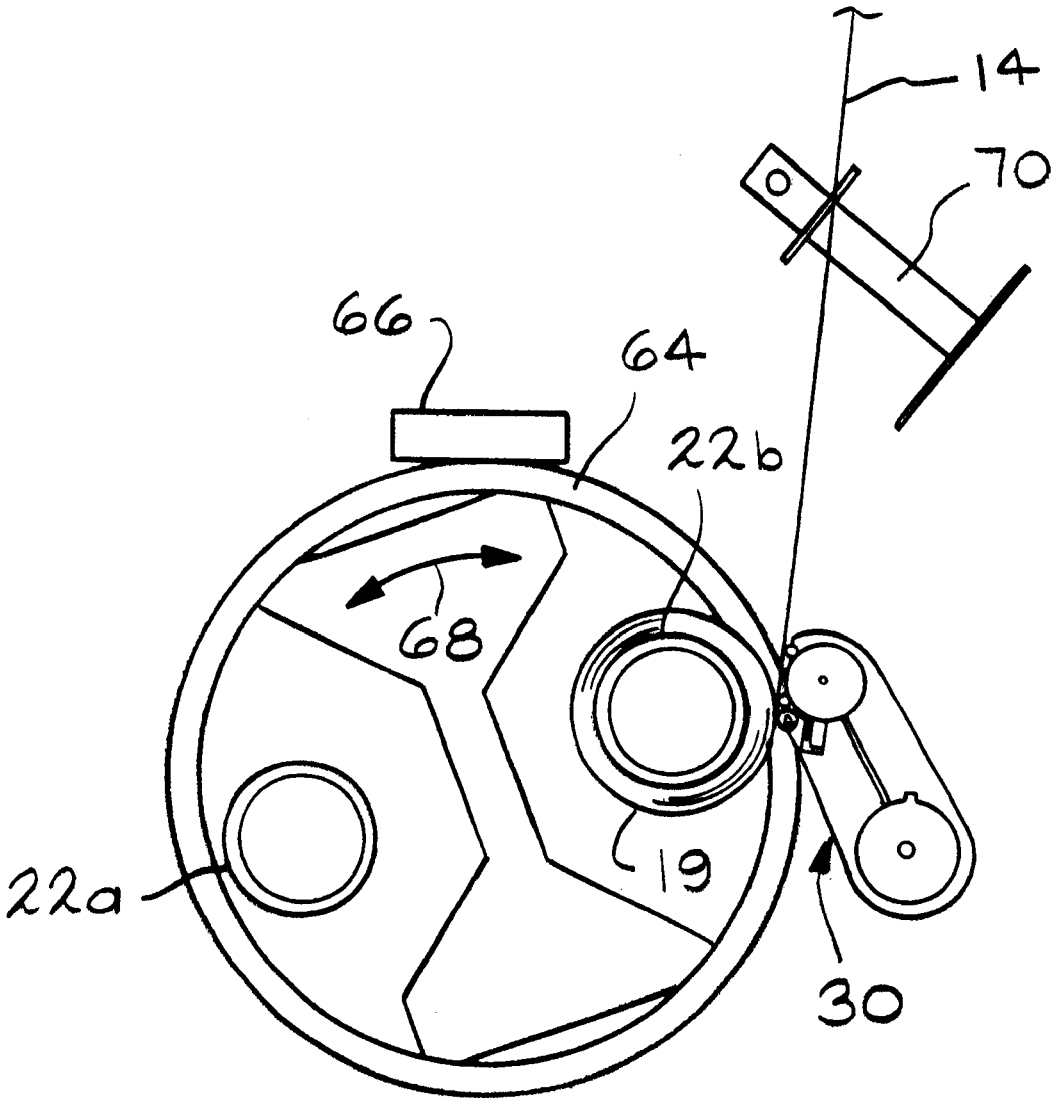
FIG. 5 is an end view in elevation of a portion of a pair of collets mounted on a rotatable turret, and further including a cam, and a strand positioner.

Referring now to FIG. 5, the apparatus of the invention includes a turret 64 for housing two or more collets 22*a*, 22*b*. It will be appreciated that the invention is not limited by the number of collets and the invention can be practiced with any desirable number of collets, including a single collet. A drive system 66, such as a servo motor, is operatively coupled to the turret 64 for bidirectional rotation of the turret 64, as indicated by arrow 68. It will be appreciated that the drive system 66 can be operatively coupled to a controller (not shown) for precisely controlling the indexing of the turret 64 and the position of the collets 22*a*, 22*b*. A strand positioner 70 may be provided to facilitate the positioning of the strand 14 on each collet 22*a*, 22*b*. The strand positioner 70 is capable of lateral movement along the direction of the length of the collet as well as pivotal movement toward and away from the collet. In this mariner, the strand positioner 70 can be precisely situated at any desired position with respect to the collets 22*a*, 22*b*. The apparatus also includes a pair of pull rolls (not shown) positioned below the level (i.e. downstream) of the turret 64 and the collets 22*a*, 22*b*.

Referring now to FIG. 6, the apparatus of the invention further includes a cam receder 90 for positioning the cam 32 with respect to each collet 22*a*, 22*b*. The receder 90 includes. a motor 92, preferably a servo motor, to move the cam 32 radially toward or away from the package during package buildup. The apparatus further includes a computer 94, such as a personal computer for storing data and executing a computer program. The computer 94 is operatively connected to a controller 96 such as a programmable logic controller (PLC). The computer 94 can provide the controller 96 with a series of reference values for the rotational speed of each collet 22*a*, 22*b*, the cam 32 and the motors 24, 35, 92 as a function of time for the package buildup. These reference values may be contained in one or more lookup tables.

Figure 7:
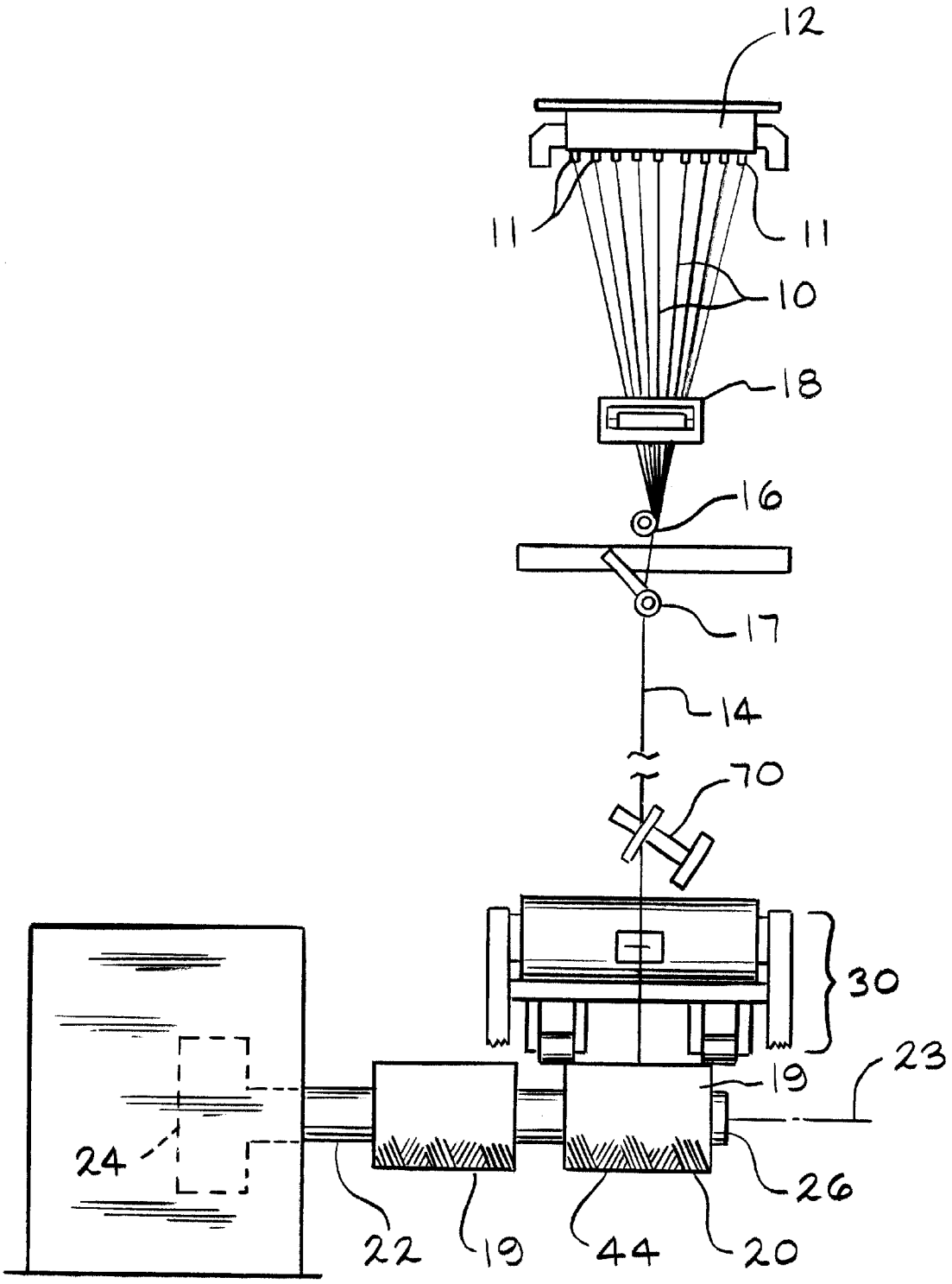
FIG. 7 is a diagrammatic view of a apparatus for building multiple packages on a single collet according to the invention.

Referring now to FIG. 7, the preferred method of forming multiple packages on a single collet in accordance with the method of the invention will be described. The process begins with the strand 14 being wound onto one of the collets 22*a*, 22*b*, for example, the collet 22*b*, to start building the first package 19 at a first location on the collet 22*b*. For example, the first package 19 may be built on the front, or outside, end of the collet 22*b*.

Once the buildup of the first package 19 is completed, the cam 32 and cam follower 36 recede away from the collet 22*b* and the strand positioner 70 moves to catch the strand 14 and pull the strand 14 onto the next location on the collet 22*b*, where a new package 19 will be built. At the same time, the secondary shoe device 17 moves the strand 14 at the sliver level laterally along the direction of the collet for proper alignment. Once the strand 14 is positioned properly on the collet 22*b*, the strand positioner 70 disengages the strand 14, and the cam 32 and cam follower 36 are moved to the next package location to begin building the next package 19 on the collet 22*b*. It will be appreciated that the invention is not limited by the number of packages. that can be built on;each collet 22*a*, 22*b*, and that the above process can be repeated to build any number of packages on each collet 22*a*, 22*b*, with the package length and collet length being the only determining factors as to how many packages can be built on each collet 22*a*, 22*b*.

When the last package 19 is completed on the collet 22*b*, the strand positioner 70 moves the strand 14 to the front of the collet 22*b* at a transfer location 72 for the transfer sequence. At the same time, the secondary shoe device 17 also moves the strand 14 to the front of the collet 22*b* as the cam 32 and cam follower 36 recede away from the collet 22*b*. Then, the turret 64 rotates clockwise approximately 180 degrees to transfer the strand 14 to the collet 22*a*. At this point, the package is ready to be built on the collet 22*a*.

Although the invention has been described with reference to glass fibers, it is to be understood that the invention could be used with other mineral fibers, or with organic fibers, or with combinations of fibers.

The principle and, mode of operation of this invention have been described in its preferred embodiments. However, it should be noted that this invention may be practiced otherwise than as specifically illustrated and described without departing from its scope.

What is claimed is:

1. A method of building multiple wound packages of strand on a collet, the method comprising the steps of:

providing a collet;

supplying a continuous strand to the collet;

rotating the collet to wind the strand to build a first package at a first location on the collet, including reciprocating the strand from one end of the package to the other end of the package using a strand reciprocator that includes a rotating cam and a cam follower having a stand guide, to reciprocate the strand from the one end to the other end as the package rotates, thereby forming strand courses;

holding the strand courses in place at edge portions of the package as the strand guide changes direction to make a square edged package; and transferring the strand, at the completion of the first package, to a second location on the collet so that a second package can be built at the second location, wherein the strand transfer includes:

moving the strand reciprocator away from the collet;

directing the strand from the first location to the second location; and moving the strand reciprocator into engagement with the collet to build a second package at the second location.

2. The method of claim 1, wherein the step of directing the strand from the first location to the second location is effected by engaging the strand with a strand positioner.

3. The method of claim 2, further including the step of disengaging the strand from the strand positioner after the strand is transferred to build the second package on the collet.

4. The method of claim 1, further including the step of moving the cam toward the collet after the strand is transferred to build the second package on the collet.

5. The method of claim 1, wherein the strand positioner moves toward the strand in a pivotal movement to engage the strand.

6. The method of claim 1, further including the step of controlling a secondary shoe and strand positioner with a controller during the movement of the strand from one package location to another package location on the collet.

7. The method of claim 1, further including the step of moving the strand positioner laterally along the direction of length of the collet during the movement of the strand from one package location to another package location on the collet.

8. The method of claim 1, further including the step of moving the strand at a sliver level with a secondary shoe during the movement of the strand from one package location to another package location on the collet.

9. A method of building multiple wound packages of strand on a collet, the method comprising the steps of:

providing a collet;

supplying a continuous strand to the collet;

rotating the collet to wind the strand to build a first package at a first location on the collet, including reciprocating the strand from one end of the package to the other end of the package using a strand reciprocator that includes a rotating cam and a cam follower having a stand guide, to reciprocate the strand from the one end to the other end as the package rotates, thereby forming strand courses;

holding the strand courses in place at edge portions of the package as the strand guide changes direction to make a square edged package; and transferring the strand, at the completion of the first package, to a second location on the collet so that a second package can be built at the second location, wherein the strand transfer includes:

moving the strand reciprocator away from the collet;

directing the strand from the first location to the second location by engaging the strand with a strand positioner, moving the strand positioner laterally along the direction of the length of the collet to move the strand to the second location, and disengaging the strand from the strand positioner, wherein a secondary shoe and strand positioner are controlled with a controller during the movement of the strand from one package location to another package location; and moving the strand reciprocator into engagement with the collet to build a second package at the second location.

10. The method of claim 9, wherein the strand positioner moves toward the strand in a pivotal movement to engage with the strand.

11. The method of claim 9, further including the step of moving the strand at a sliver level with the secondary shoe during the movement of the strand from one package location to another package location on the collet.

12. An apparatus for building multiple packages on a collet, comprising:

a rotatable collet;

a primary shoe located upstream of the collet for forming a fibrous strand;

a secondary shoe for directing the strand to the collet; a strand positioner mounted for movement toward the strand for engagement with the strand and away from the strand for disengagement with the strand, the strand positioner adapted to position the strand at multiple package locations on the collet to enable building a package at each of the package locations; and a strand reciprocator that includes a rotating cam and a cam follower having a strand guide, wherein rotation of the cam reciprocates the strand from one end of the package to the other end of the package as the collet rotates, thereby enabling the strand to be wound on the collet in courses; and a roller bail for holding the strand courses in place at edge portions of the package as the strand guide changes direction to make a square edged package;

wherein the secondary shoe and strand positioner can be operated to move the strand from one package location to another package location on the collet and the strand reciprocator is moved into engagement with the collet to build a second package at the second location.

13. The apparatus of claim 12, wherein the strand positioner is mounted for pivoting movement toward the strand for engagement with the strand.

14. The apparatus of claim 12, wherein the cam moves away from the collet as the strand is being transferred to build the second package on the collet.

15. The apparatus of claim 12, wherein the cam moves toward the collet after the strand is transferred to build the second package on the collet.

16. The apparatus of claim 12 including a controller for controlling the secondary shoe and strand positioner during the movement of the strand from one package location to another package location on the collet.

17. The apparatus of claim 12, wherein the strand positioner 70 is capable of lateral movement along the length of the collet.

18. The apparatus of claim 12, wherein the secondary shoe is mounted to move the strand at a sliver level during the movement of the strand from one package location to another package location on the collet.

19. A method of building multiple wound packages of strand on a collet, the method comprising the steps of:

providing a collet;

supplying a continuous strand to the collet;

rotating the collet to wind the strand to build a first package at a first location on the collet, including reciprocating the strand from one end of the package to the other end of the package using a strand reciprocator that includes a rotating cam and a cam follower having a stand guide, to reciprocate the strand from the one end to the other end as the package rotates, thereby forming strand courses; and transferring the strand, at the completion of the first package, to a second location on the collet so that a second package can be built at the second location, wherein the strand transfer includes:

moving the strand reciprocator away from the collet;

directing the strand from the first location to the second location; and moving the strand reciprocator into engagement with the collet to build a second package at the second location.

* * * * *